United States Patent [19]

Salleras Escalante

[11] 4,405,073

[45] Sep. 20, 1983

[54] STAPLER WITH STAPLER STORAGE SPACE

[75] Inventor: Juan D. Salleras Escalante, c/o Ave. Principal de Campo Alegre, Quinte "San Luis", Caracas, Venezuela

[73] Assignee: Juan D. Salleras Escalante, Caracas, Venezuela

[21] Appl. No.: 188,326

[22] Filed: Sep. 18, 1980

[51] Int. Cl.[3] ..... B27C 5/02

[52] U.S. Cl. ..... 227/120; 227/156

[58] Field of Search ..... 227/110, 120, 156

[56] References Cited

U.S. PATENT DOCUMENTS

| | | | |
|---|---|---|---|
| 2,676,318 | 4/1954 | Schlesinger, Jr. | 227/120 |
| 2,694,807 | 11/1954 | Schlesinger, Jr. | 227/120 X |
| 3,158,870 | 12/1964 | Priest | 227/156 |
| 3,194,465 | 7/1965 | Harrington | 227/120 |
| 3,289,910 | 12/1966 | Lescure | 227/120 X |
| 3,302,842 | 2/1967 | MacEachron | 227/156 X |
| 3,451,606 | 6/1969 | Jacobson | 227/120 X |

FOREIGN PATENT DOCUMENTS

| | | | |
|---|---|---|---|
| 2851408 | 8/1979 | Fed. Rep. of Germany | 227/120 |

*Primary Examiner*—Howard N. Goldberg
*Assistant Examiner*—Fred A. Silverberg
*Attorney, Agent, or Firm*—Gipple & Hale

[57] ABSTRACT

A stapler which includes an interchangeable staple magazine and combines desk, wall and hand stapler functions. The stapler utilizes a tensioned coil spring completely enclosed within the magazine to force a load of staples toward a staple driver, the spring varying in length less than fifty percent as the load of staples is exhausted. The self-contained nature of the magazine assembly allows space in the head of the stapler above the magazine assembly to be used for storage of spare staple loads. The head, back and base of the stapler are connected by a sliding spring rail, which allows the stapler to staple publication bindings without sacrificing stability, as well as to separate the head from the rail for use of the head as a wall tacking stapler.

6 Claims, 6 Drawing Figures

STAPLER WITH STAPLER STORAGE SPACE

BACKGROUND OF THE INVENTION

This invention generally relates to stapling devices and, more particularly, to a hand held stapler with built in storage space for additional staples.

Hand held staplers in the prior art have generally attempted to combine the functions of desk staplers, wall tacking devices and hand held staplers in a compact and portable unit. While a desk stapler is intended to rest on a flat surface and operate in response to downward pressure from a user's hand, the hand held unit is intended to operate when squeezed by a hand, and must therefore be compact and lightweight. Additionally, a stapler may act as a tacking unit when the base portion containing the anvil is swung away from the head portion, thereby allowing stapling of items to large continuous surfaces such as walls. However, desk staplers are generally intended to fasten together large volumes of material, and must have a flat base member in order to provide stability on a desk top surface, while a hand held unit is preferably designed to fit comfortably within the curved surfaces of the human hand. Therefore, attempts in the prior art to combine hand stapler and desk stapler functions have met with only limited success.

The stapling of bindings for publications such as magazines and flyers has been the subject of many stapler designs in the prior art. The problem has been to place a staple in the binding and parallel to the length thereof so as not to impede the folding and closing of the publication. One approach to this problem is illustrated in U.S. Pat. No. 3,451,606 to Jacobson in which the stapler head pivots at the staple delivery point over the anvil while remaining connected to the anvil by means of a V-shaped base plate. The binding of the publication is inserted lengthwise within the V of the base plate, so that the anvil and stapler head are aligned correctly with respect to the binding. The staple is then inserted in a normal fashion. However, the stapler is no longer stable on the desk surface because its center of gravity is no longer directly above the base plate surface which rests on the desk top.

Some prior art staplers have also provided extended staple magazines or separate staple storage containers, but these have proved bulky and unfit for hand held stapler design. An example is shown in U.S. Pat. No. 3,302,842 to MacEachron. The stapler head therein is permanently pivoted atop one end of a U-shaped base plate, so that the staple delivery point is over an anvil mounted at the other end of the base plate. Since only the anvil portion of the base plate is intended to be placed beneath the binding of a publication, the other portion of the base plate is always exposed and carries a conventional container for additional staple loads. The geometry and bulk of this unit is clearly inappropriate for a hand held stapler.

A spring is commonly used within the staple magazine of staplers to urge the staple load toward the staple delivery point. The force applied to the load by the spring varies in direct proportion to the length of the spring, so as staples are delivered and the spring compresses the load, the spring length changes and the force applied increases or decreases accordingly. Where a spring is 50% to 100% longer at the beginning of a load than at the end of the load, as is common in the prior art, the force applied to the load will correspondingly be 50% to 100% greater at the beginning than at the end. This large variance in the spring force applied to the load contributes to the tendency of the last few staples in a load to jam upon delivery.

SUMMARY OF THE INVENTION

The present invention resides in a compact stapler which meets the functional requirements of a desk stapler, a hand held stapler and a wall tacking stapler. The base of the stapler is flat for stability on desk tops. The stapler is able to place staples in pubication bindings by extension of the length of the base and head portions so that the center of gravity of the stapler remains stationary above the base during such use, thus maintaining stability. Due to an advantageous arrangement of functional elements within the stapler head, and, in particular, to the placement of the staple load spring, there is provided a substantial staple load storage space within the stapler head which does not present unwiedly bulk which hinders the user. The staple load spring is placed so that, as the staple load in the magazine is spent, the force placed on the load by the spring varies less than in conventional models, thereby reducing the likelihood of jamming at the end of the load.

These and other advantages and objects of the invention will be more readily apparent when the following discussion is read in conjunction with the drawings attached hereto, in which:

DETAILED DESCRIPTION OF THE INVENTION

Figure 1:
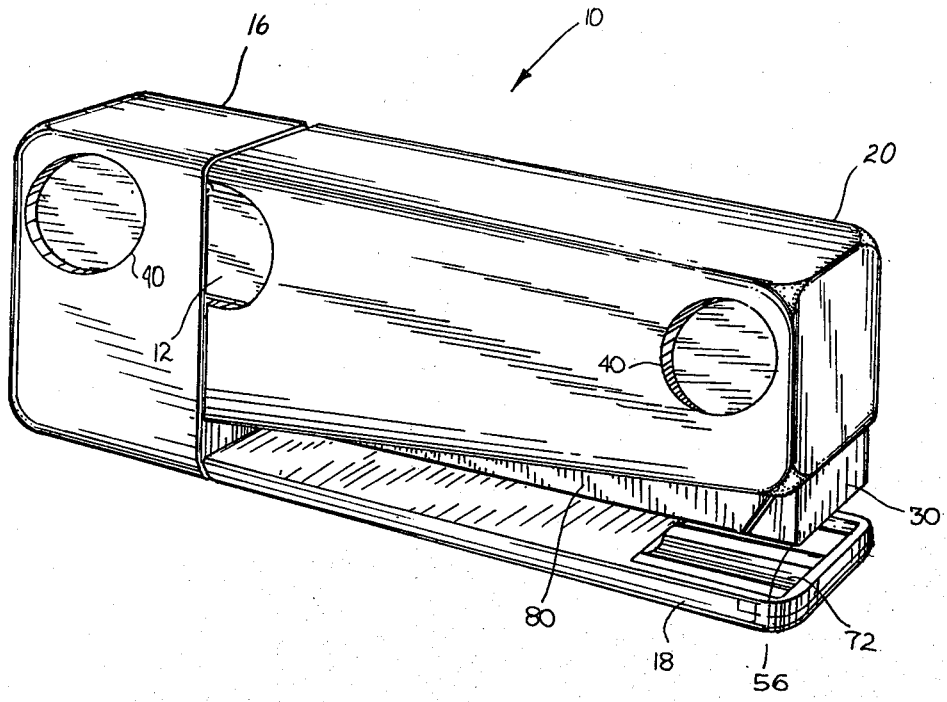
FIG. 1 is an elevated perspective view of the stapler of the invention.

A stapler in accordance with the invention is generally designated at 10 in FIG. 1. The stapler shown in FIGS. 1 through 6 constitutes the best mode of the invention. The stapler 10 shown in FIG. 1 comprises a head 20, a base 18, and a back 16. A staple magazine assembly 30 is mounted on the bottom surface of head 20 with staple delivery canal 56 of magazine 30 positioned directly above anvil 72 of base 18. Head 20 and base 18 are flexibly connected to back 16 so that the head 20 and base 18 may be pressed against one another, thereby forcing a staple through staple delivery canal 56 and any materials caught between the base 18 and head 20. The staple is then closed by being bent through the curvature of anvil 72.

Finger depressions 40 may be placed at convenient points about the head 20 and the back 16 for improved gripability.

Figure 2:
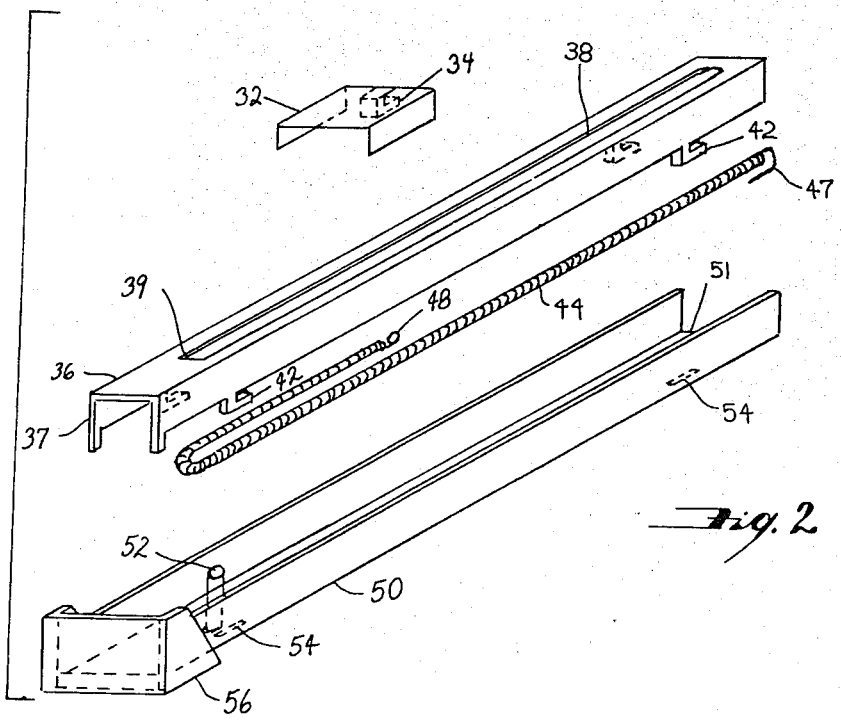
FIG. 2 is a perspective exploded view of the staple magazine of the stapler of FIG. 1.
Figure 3:
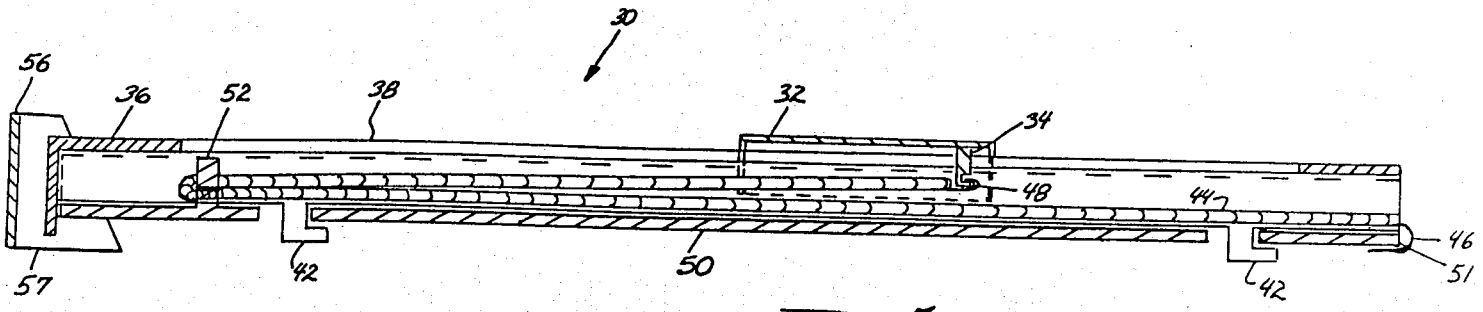
FIG. 3 is a side view partially in phantom of the staple magazine assembly of the stapler of FIG. 2.

Turning to FIGS. 2 and 3, the staple magazine assembly 30 comprises a magazine 50, a load spring 44, a channel 36 and a load pusher 32. The magazine 50 is of a generally rectangular cross section with an open top, and its interior width is equal to the exterior width of the staples to be utilized by the staple 10. A spring pivot post 52 is mounted in a vertical orientation substantially at the front end of the magazine 50. A staple driver shield 56 is mounted on the front of magazine 50, defining a driver canal between the driver shield and the magazine 50 substantially equal to the thickness of one staple. A plurality of channel retaining slots 54 are provided in the bottom of magazine 50.

A load spring 44 of the type well known in the art is attached at fixed end 47 to the back end 51 of magazine 50 in any conventional manner. The spring is drawn to and around the spring pivot 52 and back in the direction from which it was extended.

U-shaped channel 36 is substantially the same length as magazine 50, and its exterior width is the same as the interior widths of the staples to be used in the stapler 10. A plurality of channel hooks 42 are attached to the bottom of the channel 36 for locking within the channel retaining slots 54 of magazine 50. The top of channel 36 defines a coupling slot 38 which extends along the length of channel 36. The front end 39 of coupling slot 38 is placed at a distance from front end 37 of channel 36 equal to the length of the load pusher 32.

Load pusher 32 is of substantially U-shaped cross section, with interior and exterior widths equal to that of the staples to be used in the stapler 10. A spring hook 34 extends from the center of load pusher 32 through coupling slot 38 to be attached to the moving end 48 of spring 44. Thus, when assembled, load pusher 32 is urged forward by spring 44 and will press a load of staples in the magazine 50 toward the driver canal 57.

Figure 4:
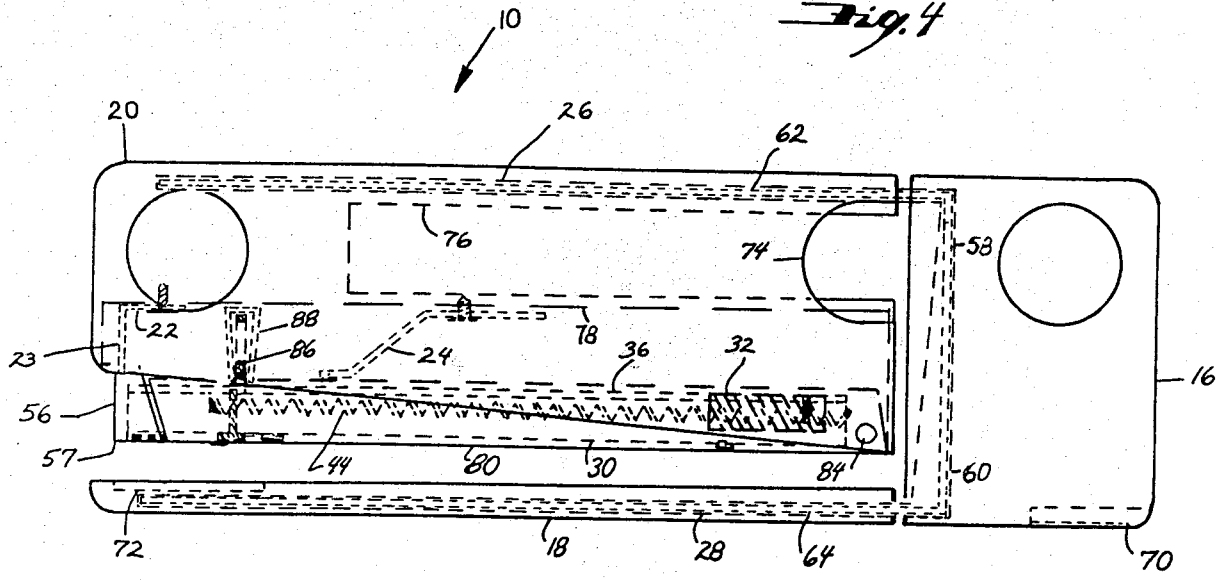
FIG. 4 is a side view partially in phantom of the stapler of FIG. 1, showing the staple magazine assembly in a loaded position.

Turning now to FIG. 4, it can be seen that the magazine assembly 50 is placed within the magazine carrier 80 of the head 20. A horizontal partition 78 above magazine carrier 80 within head 20 serves as a means to which driver 22 and magazine bias spring 24 may be attached by any conventional means. A vertical arm 23 of driver 22 is positioned directly above driver canal 57. Magazine bias spring 24 may be any flat metallic spring under compression, which forces magazine carrier 80 to its lowest position in the absence of countervaling forces. In FIG. 4, the magazine carrier is shown at its lowest position.

A magazine swing pin 86 is attached to the top of magazine carrier 80, and is inserted into a vertical magazine swing slot 88 defined within the vertical wall of head 20. Thus, the distance of which magazine carrier can pivot about pivot point 84 is limited by the distance within slot 88 that pin 86 can travel. This distance is typically equal to the length of driver arm 23 and of driver canal 57.

The base 18, back 16 and head 20 of stapler 10 are connected by means of an extension rail 60. The head 20 defines a rail slot 26 parallel to and substantially above partition surface 78, into which slot the upper portion 62 of extension rail 60 extends. The extension rail 60 exits the slot 26 at the back of head 20, and enters a slot 58 defined by back 16. The slot 58 and the rail 60 make a 90° turn to pass down through the length of back 16, and make another right-angle turn to exit the back 16 at the level of slot 28 in base 18. Slot 28 and rail 60 extend substantially the entire length of base 18.

In the head 20 of stapler 10, the space lying between the partition surface 78 and the slot 26 is utilized as a reservoir space 76 for additional staple loads. Since the reservoir space 76 is within head 20 substantially over the center of gravity of stapler 10, it provides the necessary storage capacity without contributing to the bulk or instability of the stapler 10 as a whole.

At the rear bottom edge of back 16, a thin flat blade-like staple puller 70 is provided. The staple puller 70 may be used to pry out delivered staples from stapled items.

Figure 5:
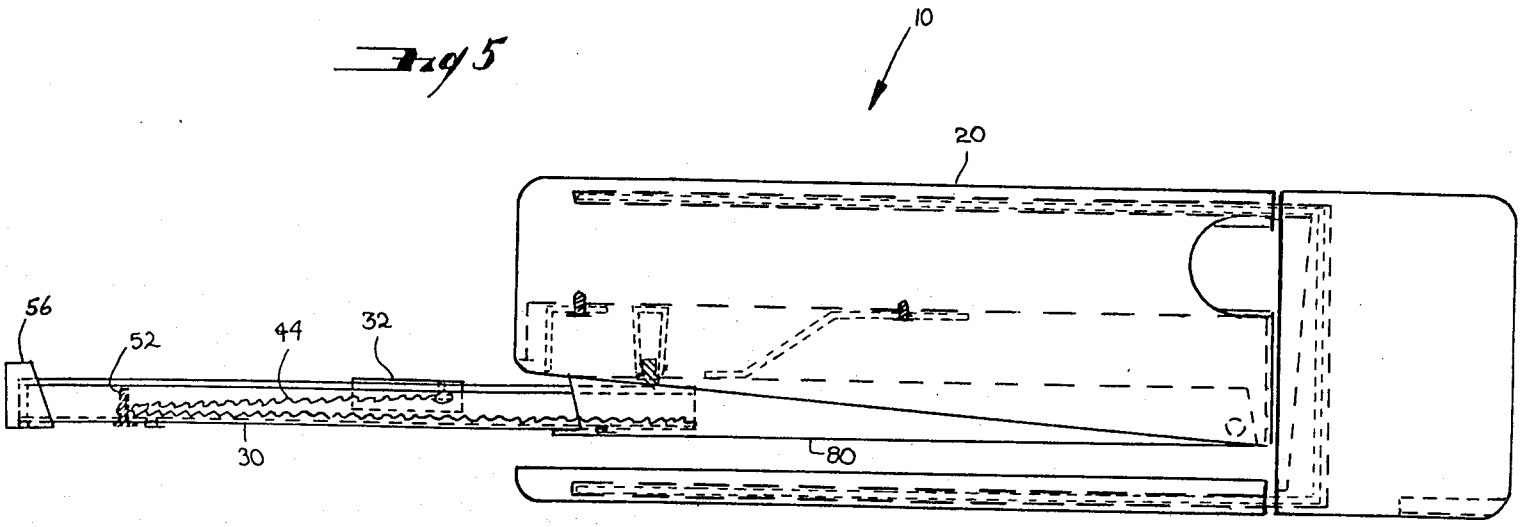
FIG. 5 is a side view partially in phantom of the stapler of FIG. 1 showing the staple magazine assembly extended for reloading.

FIG. 5 illustrates the manner in which the magazine of the stapler 10 may be reloaded. The magazine assembly 30 is shown extended from the front of magazine carrier 80. To withdraw the magazine assembly 30 to this position, the user may grasp the driver shield 56 and pull it away from the head 20 of the stapler 10. The magazine assembly 30 may be reloaded while partly removed, as shown, or may be removed completely from the magazine carrier 80. The magazine carrier 30 may be completely removed in order to further facilitate reloading or to replace the assembly 30 with alternative assemblies to accommodate different staple sizes.

In order to reload the magazine assembly 30 while it is extended, the staple pusher 32 must be moved away from driver shield 56 in order to provide a space within the magazine assembly 30 for a load of staples. As staple pusher 32 is moved, spring 44 will be pulled along therewith, thereby increasing tension in the spring 44. When staple pusher 32 is appropriately spaced from driver shield 56, a load of staples is placed into magazine assembly 30 from above. The user then releases stapler pusher 32, which is pulled by spring 44 to contact and press against the back end of the load of staples. The magazine assembly 30 is then pushed back into the magazine carrier 80, and the stapler 10 is thus reloaded and ready to continue delivering staples.

Figure 6:
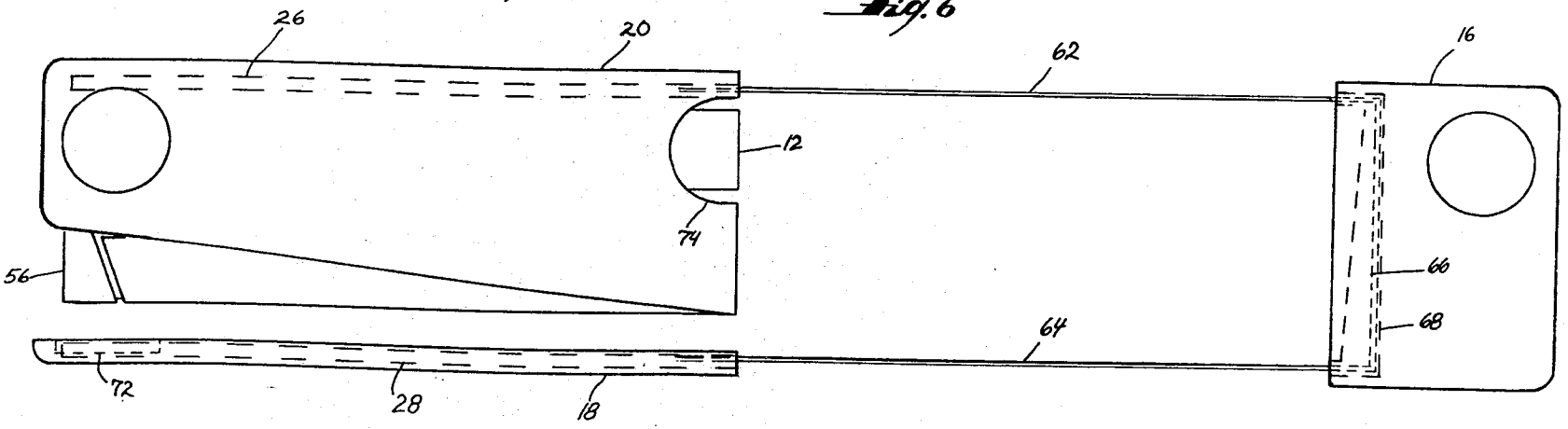
FIG. 6 is a side view partially in phantom of the stapler of FIG. 1 showing the head and base extended for placement of staples in publication bindings.

Referring now to FIG. 6, the stapler 10 is shown in extended position for delivering staples to publication bindings. The user may place the stapler 10 in this position by grasping head 20 and back 16 and pulling them apart, and then grasping base 18 and back 16 to do the same. The top rail portion 62 will slide out of slot 26 in head 20 to the extent desired by the user, and the bottom rail portion 64 will likewise slide from slot 28 in base 18 to such an extent. The distance between driver shield 56 and back 16 is thereafter great enough so that the stapler may span an entire page of the publication to reach the binding and deliver a staple appropriately oriented.

When the stapler is substantially fully extended as shown in FIG. 6, the user may have access to the stapler reservoir 12 by grasping the reservoir 12 through the semi-circular access holes 74 in opposite sides of head 20, and removing reservoir 12 from the head 20. With the reservoir 12 thus removed, the user may take a load of staples from the reservoir 2 to be added to the magazine assembly 30, or loads of staples may be placed within reservoir 12 for later use. The reservoir 12 is then replaced within reservoir space 76.

The top rail portion 62 may also be removed completely from slot 26, so that head 20 is completely disassociated from back 16 and base 18. The head 20 may thus serve as a tacking unit for mounting posters, flyers, etc. on walls.

In one working embodiment of the invention, not intended to limit the scope thereof, the extension rail 60 was composed of two millimeter thick spring steel and the head 20, back 16 and base 18 were composed of polycarbonate plastic which is amenable to premixed coloring and injection molding. The anvil 72 was composed of stainless steel and the magazine assembly 30 and magazine carrier 80 were composed of chrome plated steel. The overall dimensions of the embodiment were 17 cm from back to front, 5.7 cm in height and 2.5 cm in width, allowing space in reservoir 12 for 1000 standard office sized staples, as well as a span when extended on rail 60 of 9 inches. Thus, it will be appreciated that the invention provides a stapler which stores a significant number of staples for reloading without unwieldly bulk, delivers staples to publication bindings without sacrificing stability on a desk top, fits comfortably within the human hand for hand held use and provides a force on the staple load in the magazine assembly which varies less than 50% from the beginning to the end of the load.

It should be apparent that while the description above reveals what is now considered to be a presently preferred form of the invention, various changes may be made in the stapler without departing from the true spirit and scope of the invention as set forth in the following claims.

What is claimed is:

1. A stapler comprising a head, a back, and base; said head containing a staple driver means on an opposite end from the back and an interchangeable removeable staple magazine assembly horizontally slideably removable away from said head and said back through said opposite end, said magazine assembly comprising a magazine, a load pusher slideably mounted to said magazine, and a tensioned coiled spring completely enclosed within said magazine, and tensioned coil spring having a fixed end coupled to said magazine and a moveable end coupled to said load pusher, said load pusher being adapted to urge a load of staples through said magazine assembly to said staple driver means, said coil spring varying less than 50 percent in length as said load of staples is dispensed; said base being spaced apart from and below said head, said base having a staple anvil means directly below said staple driver means within said head; and said back having a spring rail means partially embedded within said back, said spring rail means connecting said back to said head and said spring rail means also connecting said back to said base, and wherein said magazine assembly further comprises a pivot pin fixed vertically within said magazine adjacent said staple driver means, said tensioned coil spring having said fixed end secured to an end of said magazine adjacent said back, said tensioned coil spring traversing the length of said magazine from said back to said pivot pin, said tensioned coil spring passing around said pivot pin and returning along the length of said magazine to said load pusher.

2. The apparatus of claim 1, including a stapler reservoir spaced defined within said head for storage of a plurality of said loads of staples.

3. The apparatus of claim 1 wherein said spring rail means is removeably extended through said head.

4. The apparatus of claim 3 wherein said spring rail means is removably extended through said base.

5. A stapler comprising a head, a back and a base; said head containing a staple magazine assembly and a staple driver means, wherein said staple driver means is on an opposite end from the back, said staple magazine assembly being self-contained and horizontally slideably removeable away from said head and said back through said opposite end and interchangeable so that said stapler may accommodate various staple sizes, said staple magazine assembly comprising a magazine, a tensioned coil spring completely enclosed within said magazine, a staple pusher slideably mounted to said magazine, and a vertical pin fixed within said magazine, said spring being connected to said staple pusher and passing around said vertical pin, said tensioned coil spring urging said staple pusher against a load of staples contained within said magazine with a force which varies less than fifty percent as the load of staples is exhausted, said staple driver means being adapted to drive staples from said staple magazine assembly when said head is squeezed against said base, said base being spaced apart and below said head, said base including a staple anvil directly below said staple driver means of said head; said back containing a spring rail means, said spring rail means extending from said back to flexibly connect said head to said back and to flexibly connect said base to said back.

6. A stapler comprising a head, a back, and a base; said head containing a self-contained staple magazine assembly and a staple driver, wherein said stapler driver is on an opposite end from the back, said staple magazine assembly being horizontally slideably removeable away from said head and said back through said opposite end and having a staple driver end and a back end; said staple magazine assembly comprising a magazine and a channel member fixed to said magazine, a tensioned coil spring completely enclosed between said magazine and said channel member, and a vertical pivot post fixed within said magazine, said spring having a fixed end and a moving end, said fixed end of said spring being attached to said back end of said staple magazine assembly; said vertical pivot post being adjacent said driver end of said staple magazine assembly, said spring being stretched to and around said vertical pivot post, a load pusher slideably coupled to and removeable with said channel member, said moving end of said spring being attached to said load pusher for pushing a load of staples to said staple driver end of said staple magazine assembly.

* * * * *